US006554590B2

(12) United States Patent
Maeda et al.

(10) Patent No.: US 6,554,590 B2
(45) Date of Patent: Apr. 29, 2003

(54) HIGH PRESSURE PUMP

(75) Inventors: Tomoyuki Maeda, Nagoya (JP); Kazuhiro Asayama, Nagoya (JP); Tomoji Ishikawa, Okazaki (JP); Hiroshi Inoue, Chiryu (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 09/837,249

(22) Filed: Apr. 18, 2001

(65) Prior Publication Data

US 2001/0031207 A1 Oct. 18, 2001

(30) Foreign Application Priority Data

Apr. 18, 2000 (JP) ..... 2000-116418

(51) Int. Cl.[7] ..... F04B 39/08
(52) U.S. Cl. ..... 417/505; 123/506; 251/129.02
(58) Field of Search ..... 417/505; 123/506; 251/129.02; 91/275

(56) References Cited

U.S. PATENT DOCUMENTS 4,291,860 A * 9/1981 Bauer ..... 251/129.02
4,505,240 A * 3/1985 Shinoda et al. ..... 123/506
5,190,446 A * 3/1993 Salter et al. ..... 417/297
5,603,303 A 2/1997 Okajima et al.
6,345,608 B1 * 2/2002 Rembold et al. ..... 123/506
6,347,844 B1 * 2/2002 Hosoya et al. ..... 303/119.2

FOREIGN PATENT DOCUMENTS

| | | |
|---|---|---|
| JP | 8-14140 | 1/1996 |
| JP | 10-73064 | 3/1998 |
| JP | 10-252603 | 9/1998 |

* cited by examiner

*Primary Examiner*—Cheryl J. Tyler

(57) ABSTRACT

A high pressure pump includes a cylinder body. The cylinder body has a cylinder and a valve recess communicated with the cylinder. A cover is attached to the cylinder body to surround the valve recess. A plunger reciprocates in the cylinder. An electromagnetic valve has a pressurizing chamber, a valve hole connected to the pressurizing chamber and a valve body. The valve body selectively opens and closes the valve hole. The electromagnetic valve is fixed to the cover. When fluid is pressurized in the pressurizing chamber, the valve hole is closed by the valve body and the plunger enters the pressurizing chamber. A seal ring is located between an outer surface of the electromagnetic valve and an inner surface of the valve recess. The seal ring seals the pressurizing chamber. This reliably seals a pressurizing chamber and improves the displacement efficiency.

13 Claims, 4 Drawing Sheets

HIGH PRESSURE PUMP

BACKGROUND OF THE INVENTION

The present invention relates to a high pressure pump. More particularly, the present invention pertains to a high pressure pump that includes an electromagnetic valve that selectively opens and closes a pressurizing chamber defined adjacent to a cylinder in a cylinder body.

Japanese Unexamined Patent Publication No. 8-14140 discloses a high pressure pump that pressurizes fuel supplied to an internal combustion engine. This pump includes a plunger that is located in a cylinder, which is defined in a cylinder body. A pressurizing chamber is defined in the cylinder body adjacent to the plunger. The plunger is reciprocated to pressurize fuel in the pressurizing chamber. An electromagnetic valve is located adjacent to the pressurizing chamber. The valve is controlled to adjust the displacement of the pump.

A washer and a gasket are located between the opening of the cylinder and an end of the electromagnetic valve to seal the pressurizing chamber. The washer and the gasket are tightly held between the body of the valve the opening of the cylinder to so that the pressurizing chamber is reliably sealed. In other words, a relatively high pressure is applied to the opening of the cylinder, which may deform the cylinder. Since the cylinder is machined with a high precision, the deformation increases the friction between the cylinder and the plunger. Also, the orientation of the plunger may be displaced, which prevents smooth motion of the plunger.

To reduce the friction between the inner wall of the cylinder and the surface of the plunger, the clearance between the cylinder and the plunger must be relatively great to compensate for deformation of the cylinder. However, a greater clearance causes liquid to leak from the pressurizing chamber, which lowers the discharge efficiency of the high pressure pump.

BRIEF SUMMARY OF THE INVENTION

Accordingly, it is an objective of the present invention to provide a high pressure pump that reliably seals a pressurizing chamber and improves the displacement efficiency.

To attain the above-mentioned object, the present invention provides a high pressure pump. The high pressure pump includes a cylinder body. The cylinder body has a cylinder and a communication hole communicated with the cylinder. A cover is attached to the cylinder body to surround the communication hole. A plunger reciprocates in the cylinder. An electromagnetic valve has a pressurizing chamber, a valve hole connected to the pressurizing chamber and a valve body for selectively opening and closing the valve hole. The electromagnetic valve is fixed to the cover. When fluid is pressurized in the pressurizing chamber, the valve hole is closed by the valve body and the plunger enters the pressurizing chamber. A seal ring is located between an outer surface of the electromagnetic valve and an inner surface of the communication hole. The seal ring seals the pressurizing chamber.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

A high pressure pump 2 according to a first embodiment of the present invention will now be described with reference to FIGS. 1 to 3.

Figure 1:
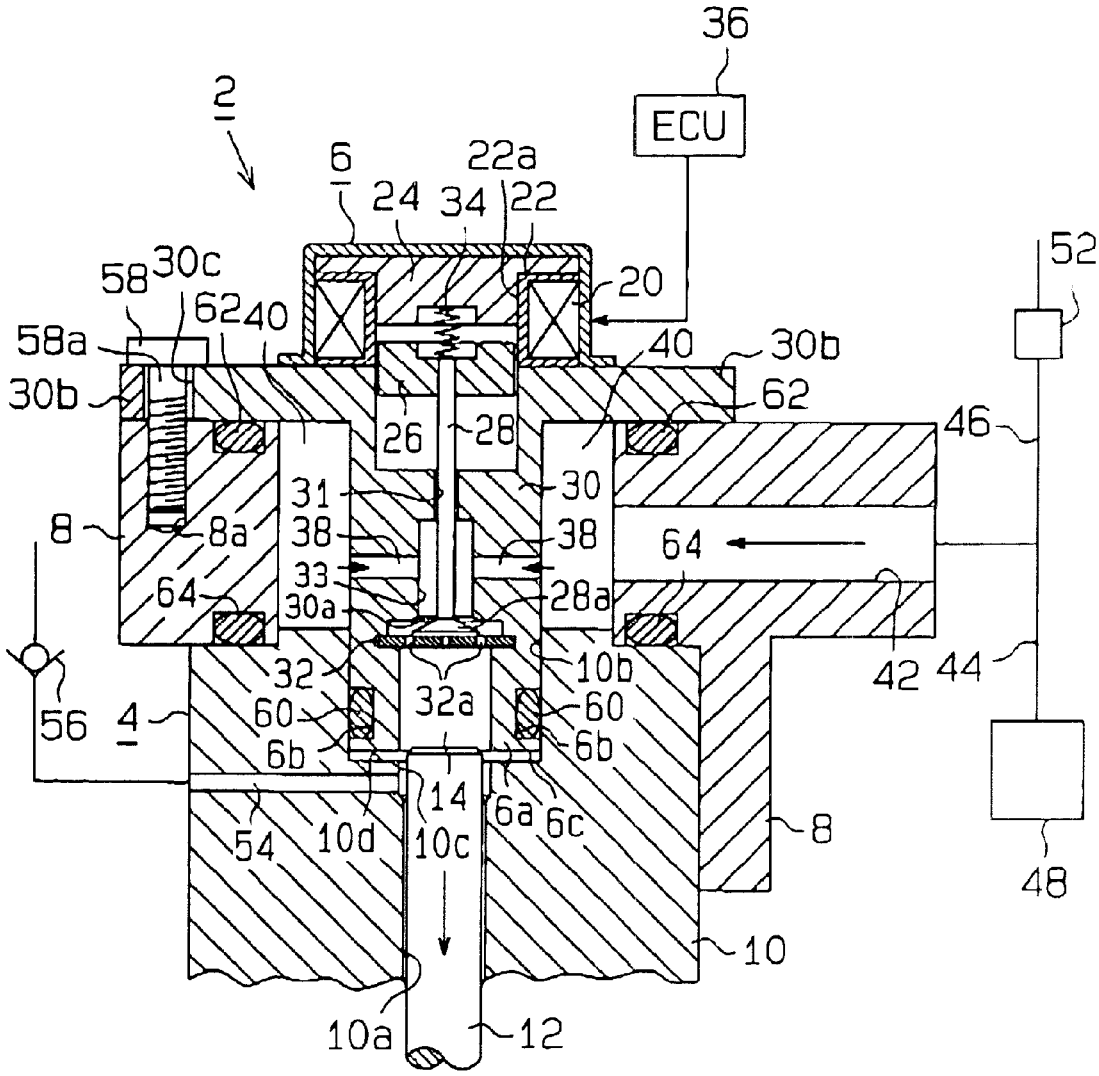
FIG. 1 is a cross-sectional view illustrating a high pressure pump according to a first embodiment of the present invention.

As shown in FIG. 1, the high pressure pump 2 includes a pump mechanism 4 and an electromagnetic valve 6. The pump mechanism 4 includes a cover 8, a cylinder body 10 and a plunger 12. A cylinder 10*a* extends axially in the cylinder body 10. A valve recess 10*b* is formed adjacent to the upper end of the cylinder 10*a*. The cover 8 is located on the cylinder body 10 and surrounds the valve recess 10*b*.

The electromagnetic valve 6 has a cylindrical portion 6*a* at the lower end portion. The cylindrical portion 6*a* is received by the recess 10*b*. A pressurizing chamber 14 is defined in the cylindrical portion 6*a*.

A plunger 12 is located in the cylinder 10*a* and is reciprocated by a cam 18, which is attached to a camshaft 16 (see FIG, 2). When reciprocated, the plunger 12 protrudes into and retracted from the pressurizing chamber 14.

The electromagnetic valve 6 includes an annular coil 20, a bobbin 22, a stationary core 24, an armature 26, a poppet valve 28, a housing 30 and a stopper 32. The cylindrical portion 6*a* is formed in the lower portion of the housing 30. The coil 20 is wound about the bobbin 22. The bobbin 22 has a through hole 22*a*. The core 24 is fitted in the through hole 22*a* of the bobbin 22.

The armature 26 is fixed to the upper end of the shaft of the poppet valve 28. The armature 26 and the core 24 are coaxial and can enter the through hole 22*a* of the bobbin 22. A compressed spring 34 is located between the core 24 and the armature 26. The spring 34 urges the armature 26 and the poppet valve 28 toward the pressurizing chamber 14.

The shaft of the poppet valve 28 extends through a shaft hole 31 formed in the housing 30. The poppet valve 28 has a substantially conical valve body 28*a*. A valve hole 33 is formed in the electromagnetic valve 6. The valve hole 33 is opened and closed by the valve body 28*a*. When current is not supplied to the coil 20, the valve body 28*a* is separated from a valve seat 30*a*, which is defined about the lower opening of the valve hole 33 in the housing 30, by the force of the spring 34 and abuts the stopper 32. At this time, the valve hole 33 is opened. When an electronic control unit (ECU) 36 supplies current to the coil 20, the core 24, the armature 26 and the housing 30 produce a magnetic circuit. As a result, the armature 26 is moved toward the core 24 against the force of the spring 34. Accordingly, the poppet valve 28 separates from the stopper 32 and the valve body 28*a* contacts the valve seat 30*a*. At this time, the valve hole 33 of the electromagnetic valve 6 is closed.

Figure 3:
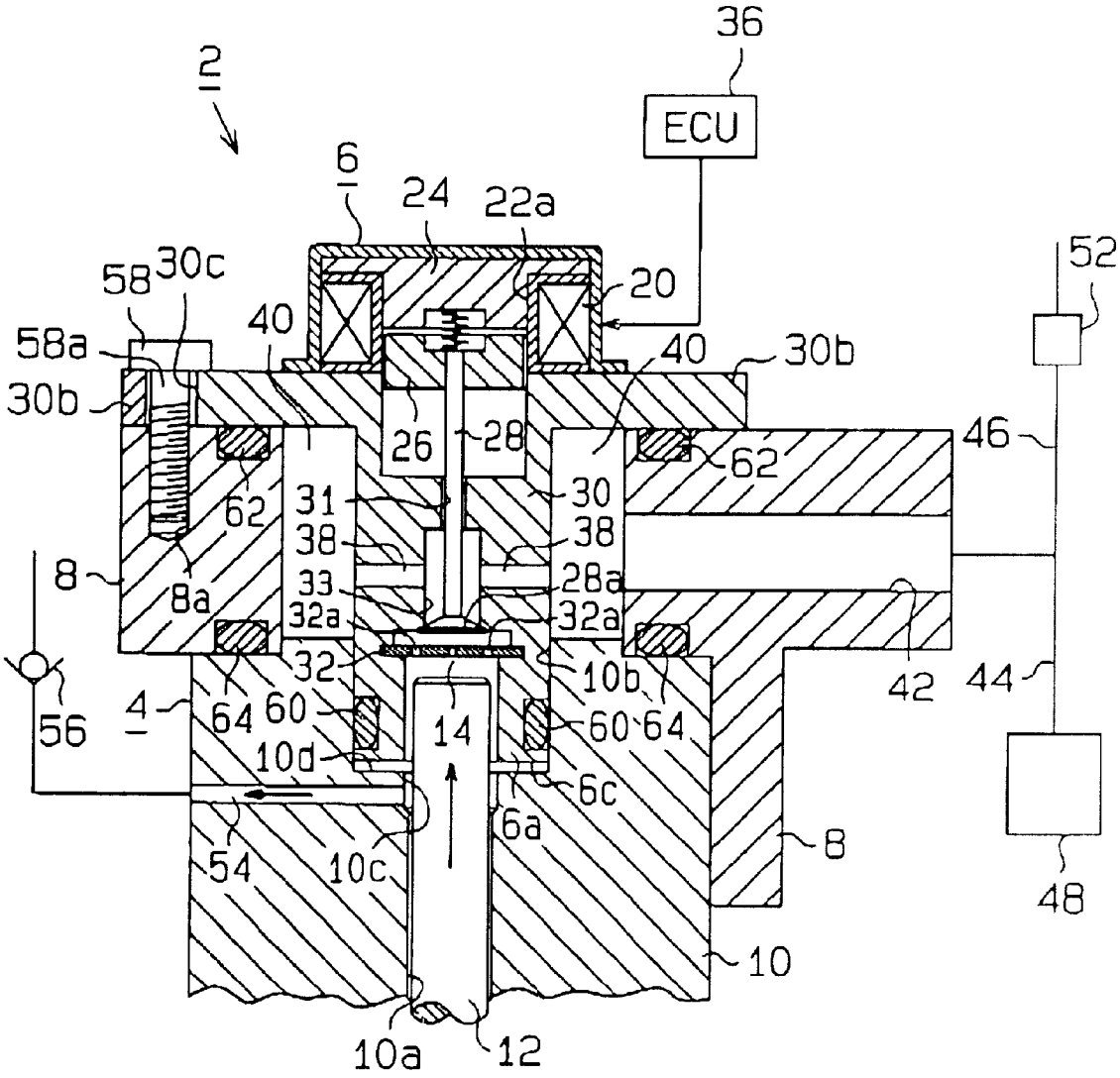
FIG. 3 is a cross-sectional view like FIG. 1 when the valve body of the high pressure pump closes the valve hole.

As shown in FIGS. 1 and 3, the stopper 32 faces the valve body 28*a* of the poppet valve 28. Supply passages 38 are formed in the housing 30. Holes 32*a* are formed in the stopper 32. The holes 32*a* permit flow of fuel. When the electromagnetic valve 6 is opened as shown in FIG. 1, the holes 32*a* permit fuel to flow between the supply passages 38 and the pressurizing chamber 14.

A gallery 40 is defined between the housing 30 and the cover 8. A supply passage 38 is formed in the cover B. The supply passages 38 are connected to a low pressure passage 44 and a return passage 46 by the gallery 40 and the fuel passage 42. The low pressure passage 44 is connected to a fuel tank 48. As shown in FIG. 2, the high pressure fuel pump 2 receives fuel from a feed pump 48*a* in the fuel tank 48. The return passage 46 is connected to a relief valve 52. The relief valve 52 returns excess fuel from a fuel distribution pipe 50 to the pressurizing chamber 14. The high pressure fuel pump 2 reuses fuel that is returned from the distribution pipe 50 through the relief valve 52.

As shown in FIGS. 1 and 3, a large diameter portion 10*c* is formed in the upper portion of the cylinder 10*a*. The pressurizing chamber 14 communicates with the large diameter portion 10*c*. A high pressure passage 54, a part of which is formed in the cylinder body 10, is connected to the pressurizing chamber 14 through the large diameter portion 10*c*. In the cylinder body 10, the high pressure passage 54 extends perpendicular to the pressurizing chamber 14. A check valve 56 is located in the high pressure passage 54. The pressurizing chamber 14 is connected to the fuel distribution pipe 50 by the high pressure passage 54 and the check valve 56.

The check valve 56 permits fuel to flow from the pressurizing chamber 14 to the fuel distribution pipe 50. The check valve 56 also prevents fuel from flowing from the distribution pipe 50 to the pressurizing chamber 14. If the plunger 12 projects into the pressurizing chamber 14 when the electromagnetic valve 6 is closed, pressure of fuel in the pressurizing chamber 14 is increased. At this time, the pressurized fuel is sent to the distribution pipe 50 through the high pressure passage 54 and the check valve 56. When the plunger 12 is retracted from the pressurizing chamber 14, fuel is drawn to the pressurizing chamber 14 from the fuel passage 42 through the gallery 40, the supply passage 38 and the holes 32*a*.

A flange 30*b* is formed in the upper portion of the housing 30. Bolt holes 30*c* (only one is shown in FIG. 1) are formed in the flange 30*b*. Threaded holes 8*a*, the number or which corresponds to the number of the bolt holes 30*c*, are formed in the cover 8. A bolt 58 extends through each bolt hole 30*c* and threaded to the corresponding threaded hole 8*a*, which fastens the electromagnetic valve 6 to the pump mechanism 4.

The diameter of each bolt hole 30*c* is greater than the diameter of the shaft 58*a* of each bolt 58 by a predetermined value. Therefore, before the bolts 58 are fastened tightly to the threaded holes 8*a*, the housing 30 can be moved relative to the cover 8 within a predetermined range. The housing 30 is fixed to the cover 8 by fastening the bolts 58.

An annular groove 6*b* is formed in the circumference of the cylindrical portion 6*a* of the electromagnetic valve 6. An O-ring 60 is fitted in the groove 6*b*. The O-ring 60 is elastically deformed and is supported between the surface of The cylindrical portion 6*a* and the recess 10*b* to seal the pressurizing chamber 14. The O-ring 60 is made of elastic material such as silicone rubber.

The electromagnetic valve 6 is installed in the following manner. First, the cover 8, the cylinder body 10 and other parts are integrated by an assembler (not shown) to form a pump mechanism 4.

Then, the cylindrical portion 6*a* of the electromagnetic valve 6 is inserted into the recess 10*b* of the cylinder body 10. A small clearance exists between the cylindrical portion 6*a* and the recess 10*b*. However, the O-ring 60, which is fitted about the cylindrical portion 6*a*, contacts the recess 10*b* and is elastically deformed to seal the pressurizing chamber 14. As the O-ring 60 is deformed, the axis of the cylindrical portion 6*a* matches with the axis of the recess 10*b*.

Since the diameter of the bolt holes 30*c* is greater than that of the shafts 58*a* of the bolts 58, the cylindrical portion 6*a* can be moved radially within a predetermined range even if the bolts 58 is partially engaged with the threaded holes 8*a*. Therefore, the position of the cylindrical portion 6*a* is determined by the O-ring 60. Thereafter, the bolts 58 are fastened to fix the flange 30*b* to the cover 8.

The gallery 40 is sealed by an O-ring 62 that is located between the cover 8 and the flange 30*b* and an O-ring 64 that is located between the cover 8 and the cylinder body 10.

Figure 2:
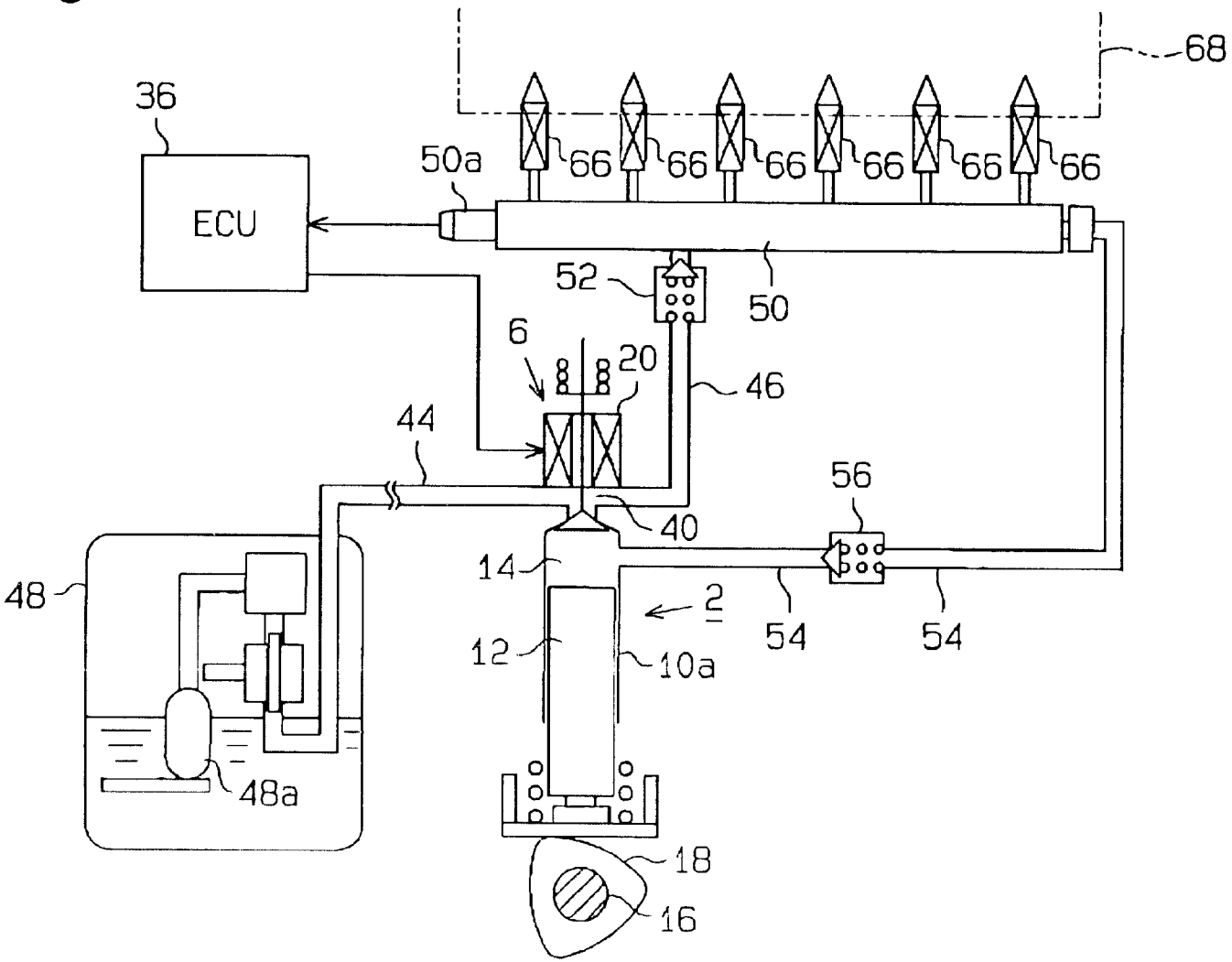
FIG. 2 is a diagram illustrating the fuel supply system of an internal combustion engine that has the high pressure pump of FIG. 1.

As shown in FIG. 2, the high pressure fuel pump 2 is used in a fuel supply system of an in-cylinder fuel injection type gasoline engine 68. In the engine 68, fuel is directly injected into combustion chambers (not shown). When the engine 68 is running, the camshaft 16, which is coupled to the crankshaft, is rotated. Accordingly, the cam 16 is rotated, which reciprocates the plunger 12 in the cylinder 10*a*. When the plunger 12 is moved downward away and retracts from the pressurizing chamber 14 as shown by an arrow in FIG. 1, the volume of the pressurizing chamber 14 is increased. This stroke is referred to as suction stroke. In the suction stroke, fuel is supplied to the pressurizing chamber 14 from the low pressure passage 44 or from the return passage 46 through the fuel passage 42, the gallery 40, the supply passage 38 and the holes 32*a*.

When the plunger 12 is moved upward into the pressurizing chamber 14, the volume of the pressurizing chamber 14 is decreased. This stroke will be referred to as a pressurizing stroke. If the electromagnetic valve 6 is opened during a pressurizing stroke, fuel in the pressurizing chamber 14 is returned to the fuel passage 42 through the holes 32*a*, the supply passage 38 and the gallery 40. The valve body 28*a* of the poppet valve 28 closes the valve hole 33 at an appropriate timing during the pressurizing stroke, which raises the pressure in the pressurizing chamber 14. The pressurized fuel in the pressurizing chamber 14 is supplied to the fuel distribution pipe 50 through the high pressure passage 54, the check valve 56. Accordingly, the pressurized fuel is supplied to fuel injectors 66, which are shown in FIG. 2. That is, fuel is supplied to each fuel injector 66 when the corresponding compression chamber is in the compression stroke. The timing at which the electromagnetic valve 6 closes the valve hole 33 is controlled by the ECU 36 in accordance with the pressure detected by a fuel pressure sensor 50*a* located in the distribution pipe 50 and the amount of fuel injected from the fuel injectors 66. In this manner, the flow rate of pressurized fuel that is sent from the high pressure pump 2 to the distribution pipe 50 is controlled such that the pressure of injected fuel is appropriate.

The embodiment of FIGS. 1 to 3 has the following advantages.

The pressurizing chamber 14 is sealed by the O-ring 60, which is located between the cylindrical portion 6*a* of the electromagnetic valve 6 and the recess 10*b*. Therefore, unlike the prior art high pressure valves, the electromagnetic valve 6 need not be pressed in the axial direction toward the cylinder body 10. Thus, the part surrounding the cylinder 10*a* does not receive load from the valve 6. As a result, the cylinder 10*a* is not deformed.

The pressurizing chamber 14 is sealed without deforming the cylinder 10*a*. Thus, the clearance between the cylinder 10*a* and the plunger 12 can be reduced, which increases the discharge efficiency.

The cylindrical portion 6*a* of the electromagnetic valve 6 is inserted into the recess 10*b* of the cylinder body 10. The volume of the pressurizing chamber 14 is relatively small. Specifically, the volume of the pressurizing chamber 14 is smaller than the volume of the recess 10*b* substantially by the volume of part of the cylindrical portion 6*a* that is located in the recess 10*b*. Therefore, as the plunger 12 strokes, the pressure of fuel in the pressurizing chamber 14 is quickly increased, which improves the discharge efficiency.

When the plunger 12 projects into the pressurizing chamber 14, the plunger 12 must be accurately guided into the pressurizing chamber 14 by the cylinder 10*a*. In the embodiment of FIGS. 1 to 3, the cylinder 10*a* is prevented from being deformed. Thus, the plunger 12 is accurately and easily guided into the pressuring chamber 14 by the cylinder 10*a*.

The clearance between the pressurizing chamber 14 and the plunger 12 can be reduced. Accordingly, the volume of the pressurizing chamber 14 is reduced, which improves the discharge efficiency.

The O-ring 60 is located between the outer surface of the electromagnetic valve 6 and the wall of the recess 10*b*. When the electromagnetic valve 6 is installed by inserting the cylindrical portion 6*a* into the recess 10*b* of the cylinder body 10, the elastic force of the O-ring 60 equally acts on the cylinder body 10 in the radial directions. Therefore, the axis of the cylindrical portion 6*a* is matched with the axis of the recess 10*b*.

In other words, the O-ring 60 permits the electromagnetic valve 6 to be accurately installed in the cylinder body 10. Also, the diameter of the bolt holes 30*c* is greater than the diameter of the shafts 58*a* of the bolts 58. Therefore, the shape and the position of each bolt 58 need not be highly accurate. That is, the bolts 58 do not require high machining accuracy. Also, the position of each threaded hole 8*a* need not be highly accurate. This structure reduces the machining cost of the high pressure pump 2.

Since the valve 6 is installed with a high accuracy in the recess 10*b*, the clearance between the pressurizing chamber 14 and the plunger 12 can be reduced compared to the prior art pumps. As a result, leak of fuel from the pressurizing chamber 14 is reduced. Thus, as the plunger 12 strokes, the pressure of fuel is quickly increased, which improves the discharge efficiency.

The electromagnetic valve 6 is fixed to the cover 8, which is separately formed from the cylinder body 10. Therefore, deformation of the cylinder 10*a* due to installation of the electromagnetic valve 6 is decreased. As a result, the clearance between the cylinder 10*a* and the plunger 12 can be further reduced, which improves the discharge efficiency.

Figure 4:
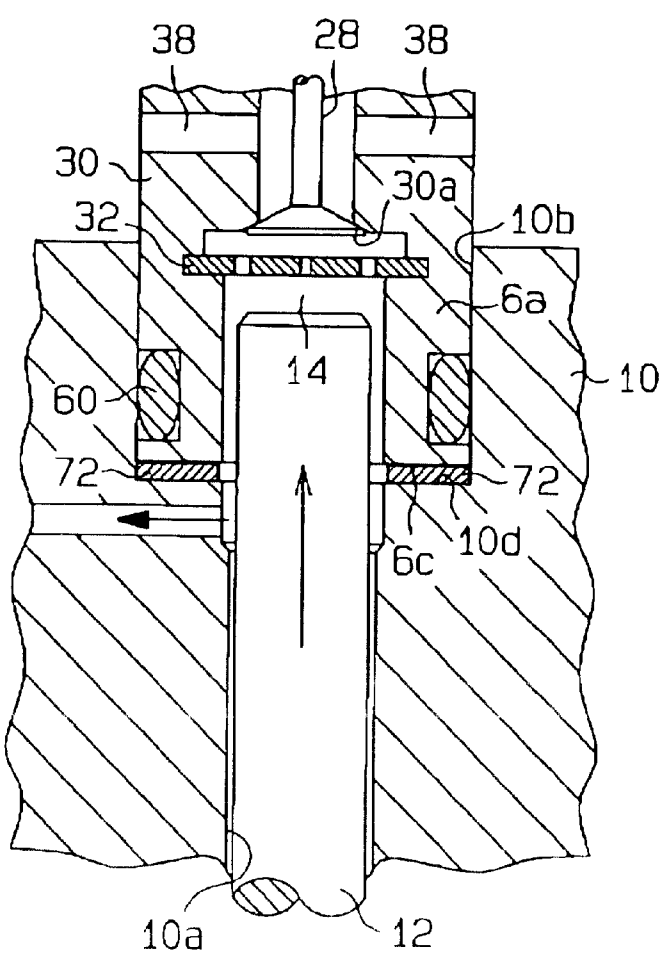
FIG. 4(A) is a cross-sectional view illustrating a high pressure pump according to a second embodiment.
FIG. 4(B) is a cross-sectional view illustrating a high pressure pump according to a third embodiment.
Figure 4:
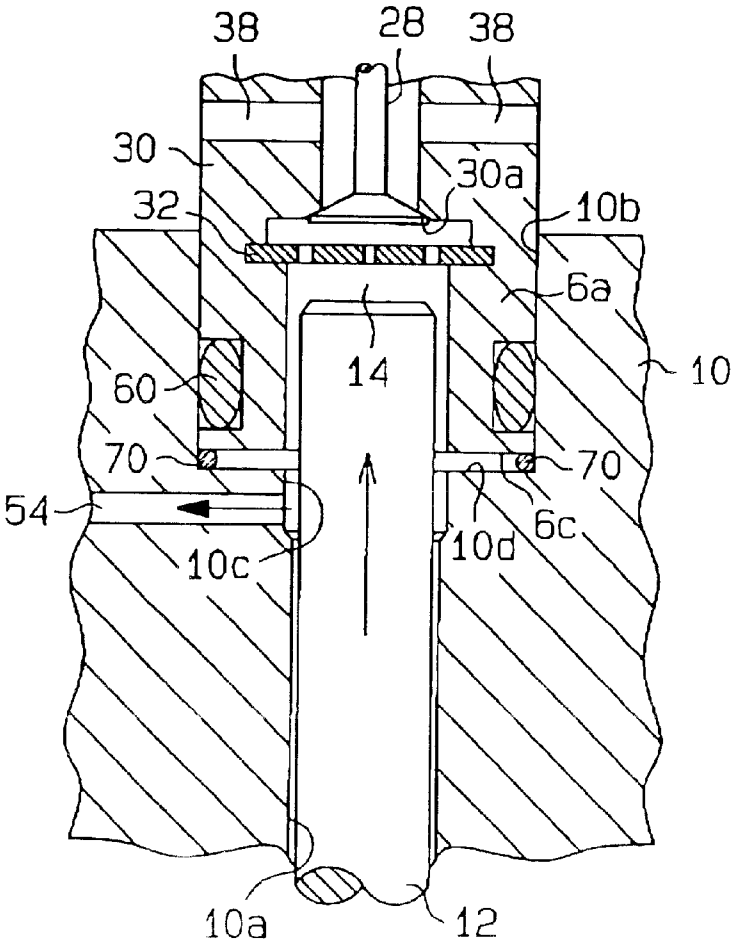

FIG. 4(A) illustrates a second embodiment. The second embodiment is different from the embodiment of FIGS. 1 to 3 in that an annular absorber 70 is located between the lower face 6*c* of the cylindrical portion 6*a* of the electromagnetic valve 6 and the bottom 10*d* of the recess 10*b*. The absorber 70 prevents pressure pulsation.

The absorber 70 is made of a material that is durable against fuel and pressure pulsation. For example, the absorber 70 is made of a metal or a resin. The axial dimension of the absorber 70 is determined such that the force of the absorber 70 does not deform the cylinder 10*a*. For example, axial dimension of the absorber 70 is smaller than the distance between the lower face 6*c* and the bottom 10*d*.

FIG. 4(B) illustrates a third embodiment. In the third embodiment, an annular absorber 72 that has a rectangular cross section is used.

In addition to the advantages of the embodiment shown in FIGS. 1 to 3, the embodiments of FIGS. 4(A) and 4(B) have the following advantages.

If the valve body 28*a* of the poppet valve 28 contacts the valve seat 30*a* when the plunger 12 is being pressurizing fuel in the pressurizing chamber 14, the pressure of the fuel is abruptly increased. Then, pressure pulsation is transmitted from the pressurizing chamber 14 to the O-ring 60 through the space between the cylindrical portion 6*a* and the recess 10*b*. However, the absorbers 70, 72 of FIGS. 4(A) and 4(B) prevent pressure pulsation from being transmitted to the O-ring 60. Therefore, wear of the O-ring 60 is reduced, which extends the life of the O-ring 60.

The present invention may be applied to other types of high pressure pumps. For example, the present invention may be applied to a high pressure pump that changes the displacement by adjusting the opening timing of an electromagnetic valve during suction stroke to control the amount of fuel that is drawn to a pressurizing chamber.

The present invention may be applied to a high pressure pump that pressurizes fluid other than fuel.

Therefore, the present examples and embodiments are to be considered as illustrative and not restrictive and the invention is not to be limited to the details given herein, but may be modified within the scope and equivalence of the appended claims.

What is claimed is:

1. A high pressure pump comprising:

a cylinder body, wherein the cylinder body has a cylinder and a communication hole communicated with the cylinder;

a cover attached to the cylinder body to surround the communication hole;

a plunger that reciprocates in the cylinder;

an electromagnetic valve having a pressurizing chamber, a housing attached to the cover, wherein the housing has a valve seat and a valve hole connected to the pressurizing chamber, and a valve body for selectively contacting to and separating from the valve seat to selectively open and close opening and closing the valve hole, wherein the electromagnetic valve is fixed to the cover, wherein, when fluid is pressurized in the pressurizing chamber, the valve hole is closed by the valve body and the plunger enters the pressurizing chamber; and a seal ring located between an outer surface of the electromagnetic valve and an inner surface of the communication hole, wherein the seal ring seals the pressurizing chamber, wherein the electromagnetic valve has a cylindrical portion, which is located in the communication hole, wherein the pressurizing chamber is formed in the cylindrical portion, and wherein the seal ring is located between an outer surface of the cylindrical portion and the inner surface of the communication hole.

2. The high pressure pump according to claim 1, wherein the seal ring positions the electromagnetic valve such that the communication hole and the electromagnetic valve are coaxial.

3. The high pressure pump according to claim 1, wherein, when the valve hole is opened by the valve body, the valve body enters the pressurizing chamber, wherein, when the valve hole is closed, the valve body is away from the pressurizing chamber.

4. The high pressure pump according to claim 1, wherein an absorber is located between the inner surface of the communication hole and the outer surface of the cylindrical portion, wherein the absorber prevents transmission of pressure pulsation to the seal ring.

5. The high pressure pump according to claim 1, wherein the seal ring is O-ring made of rubber.

6. The high pressure pump according to claim 1, wherein a part that the electromagnetic valve corresponds to the seal ring is exposed to the pressurizing chamber.

7. A high pressure pump comprising:

a cylinder body, wherein the cylinder body has a cylinder and a communication hole communicated with the cylinder;

a cover attached to the cylinder body to surround the communication hole, wherein the cover has a through hole;

a plunger that reciprocates in the cylinder;

an electromagnetic valve having a pressurizing chamber, a housing attached to the cover, wherein the housing has a valve seat and a valve hole connected to the pressurizing chamber, and a valve body for selectively contacting to and separating from the valve seat to selectively open and close opening and closing the valve hole, wherein, when fluid is pressurized in the pressurizing chamber, the valve hole is closed by the valve body and the plunger enters the pressurizing chamber;

a fastener located in the through hole cover, wherein the fastener fixes the electromagnetic valve to the cover; and a seal ring located between an outer surface of the electromagnetic valve and an inner surface of the communication hole, wherein the seal ring seals the pressurizing chamber, wherein the electromagnetic valve has a cylindrical portion, which is located in the communication hole, wherein the pressurizing chamber is formed in the cylindrical portion, and wherein the seal ring is located between an outer surface of the cylindrical portion and the inner surface of the communication hole.

8. The high pressure pump according to claim 7, wherein the fastener is annular, and wherein the diameter of the through hole is greater than outer diameter of the fastener.

9. The high pressure pump according to claim 7, wherein the seal ring positions the electromagnetic valve such that the communication hole and the electromagnetic valve are coaxial.

10. The high pressure pump according to claim 7, wherein, when the valve hole is opened by the valve body, the valve body enters the pressurizing chamber, wherein, when the valve hole is closed, the valve body is away from the pressurizing chamber.

11. The high pressure pump according to claim 7, wherein an absorber is located between the inner surface of the communication hole and the outer surface of the cylindrical portion, wherein the absorber prevents transmission of pressure pulsation to the seal ring.

12. The high pressure pump according to claim 7, wherein the seal ring is O-ring made of rubber.

13. The high pressure pump according to claim 7, wherein a part that the electromagnetic valve corresponds to the seal ring is exposed to the pressurizing chamber.

* * * * *

UNITED STATES PATENT AND TRADEMARK OFFICE

CERTIFICATE OF CORRECTION

PATENT NO. : 6,554,590 B2
DATED : April 29, 2003
INVENTOR(S) : Tomoyuki Maeda et al.

It is certified that error appears in the above-identified patent and that said Letters Patent is hereby corrected as shown below:

Column 2,
Line 36, change "(see FIG, 2)." to -- (see FIG. 2). --.

Column 3,
Line 8, change "cover B." to -- cover 8. --.
Line 63, change "The cylindrical" to -- the cylindrical --.

Column 4,
Line 27, change "cam 16" to -- cam 18 --.

Signed and Sealed this

Thirtieth Day of March, 2004

JON W. DUDAS
*Acting Director of the United States Patent and Trademark Office*